United States Patent [19]

Harding-Randle

[11] Patent Number: 4,749,186

[45] Date of Patent: Jun. 7, 1988

[54] GYNECOLOGY EXERCISE DEVICE

[76] Inventor: Andreaa Harding-Randle, 12767 East End Ave., Chino, Calif. 91710

[21] Appl. No.: 828,212

[22] Filed: Feb. 10, 1986

[51] Int. Cl.[4] ..... A61F 5/00

[52] U.S. Cl. ..... 272/93; 128/DIG. 25; 128/79

[58] Field of Search ..... 128/79, 31, 75 R, 68, 128/69, 341, DIG. 25; 272/DIG. 10, 125, 135, 137, 126, 93; D6/601; 5/437, 439, 436, 443, 434

[56] References Cited

U.S. PATENT DOCUMENTS

| | | | |
|---|---|---|---|
| D. 264,507 | 5/1982 | Haase | D6/601 |
| 2,700,779 | 2/1955 | Tolkowsky | 128/68 |
| 3,921,975 | 11/1975 | Pridgen | 272/118 X |
| 4,210,323 | 7/1980 | Feather | 272/126 |
| 4,241,912 | 12/1980 | Mercer | 128/341 |
| 4,574,791 | 3/1986 | Mitchener | 272/93 |

*Primary Examiner*—Richard J. Apley
*Assistant Examiner*—James Prizant
*Attorney, Agent, or Firm*—Melvin R. Stidham

[57] ABSTRACT

This device is designed to effectively restore the muscles of the pelvic floor of a patient. Primarily, it consists of a main body with an upper front horn portion for engagement with the exterior of the vulva without pinching it. A pair of rearwardly extending wing portions are provided on the device and engage with the inner portions of the thighs of the patient, and a spring portion in the wings is provided, for returning the wings to their normal outwardly extending positions after being compressed.

5 Claims, 1 Drawing Sheet

GYNECOLOGY EXERCISE DEVICE

BACKGROUND OF THE INVENTION

1. Field of the Invention

This invention relates to exercise devices, and more particularly, to a gynecology exercise device.

2. Description of Prior Art

Holding everything in place underneath the pelvis is a hammock of muscles known as the pelvic floor, which is enormously stretched by childbirth. The pelvic floor muscles are divided into a deep and superficial layer and have three openings; the urethra (from the bladder) the vagina (from the uterus) and the anus (from the bowel). The muscle fibers surround each of these openings in a figure eight, and the muscles are interconnected and work as a complete unit. The wedge of muscles between the vagina and the anus, is known as the perineum or the sphincter muscle. During pregnancy, the pelvic floor will have to carry the increased weight of the baby and the water in the uterus, and during the second stages of labor it will be thinned out and stretched open around the head and body of the baby. It may also be damaged by a tear or episiotomy. The vaginal cavity stretches enormously at childbirth.

Even with the remarkable elasticity of the perineum muscles (sphincter), they may never again have the strength that muscle once had, unless something can be done to redevelop those muscles. Up until now, physicians could only advise their patients to perform the "Kegel" exercise that can be done while sitting or standing. To perform the "Kegel" exercise, one contracts and releases the muscle tension of the pelvic floor. However, this is not enough, and the results that are achieved are not enough to completely restore the muscle strength, and these little results take too long to achieve. The only other alternative was reconstruction of the vagina. Furthermore, vaginal air, inability to hold a tampon, and other problems due to poor floor muscles, occurs when the muscles of the perineal and surrounding areas stretch out of shape or lose resiliency for any reason.

These muscles consist of gluteus maximus, levator ani, sphincter muscles, various small muscles and an assortment of ligaments. The gluteus maximus is the large buttock muscle, and when it becomes relaxed and sloppy, the results extend into the pelvic floor and create a relaxed condition. Also important is the gracilis muscle which runs from the middle of the pelvic floor outward and on down the inside of the leg. The adductor muscles join the same area. All these muscles come together and join the small but important muscles in the pubic area to create the pelvic floor.

Loose pelvic floor muscles resulting from being stretched and thinned out in childbirth, damaged with a tear or episiotomy, or poor muscle tone in any or all muscles, results in the inability to maintain proper tension and closure on any one or all three of the openings of the area: The urethra, the vagina, and the anus. Strong pelvic floor muscles are an essential for the control of the bladder. If the muscles are loose and sloppy, women experience uncontrollable leakage of urine when they laugh, cough, sneeze, blow their nose or lift something heavy, or run.

When the pelvic floor muscles are left undeveloped, damaged or deteriorated, diminished sexual pleasure and psychologically disturbing feelings of sexual inadequacies can result. Many women have complained that when they have intercourse, air floods into the vagina and exits noisily, which creates psychological stigma and embarrassment. This can also happen in certain positions and movements in daily routine, and in exercise. Many women have also complained that they have trouble even holding in a tampon.

Eventually most women are faced with one or more of these problems, and they are even more of a concern to women who have given birth. However, these are not the only problems. Poor muscle tone in the pelvic floor and related muscles, causes the uterus to fall forward into the vaginal cavity, and this condition left untreated, can eventually cause the uterus to protrude out of the vaginal opening. The above is life-threatening during birth. Also, as internal organs prolase into unsupported areas, backaches are the inevitable result.

The physical problems are devastating enough, but when they are coupled with the anxiety that can result over intimate relationship problems, there is the makings for serious depression, also a national problem among women. The gynecology exercise device in accordance with the present invention, is designed to be positively effective redeveloping the pelvic muscle floor.

The principal object of this invention is to provide a gynecology exercise device, which will be of unique design, in that its structure will enable the redevelopment of the pelvic muscle floor.

Another object of this invention is to provide a gynecology exercise device, which will be fabricated to include a main body having a spring portion therein, for aiding in its proper performance for the user.

SUMMARY OF THE INVENTION

Figure 1:
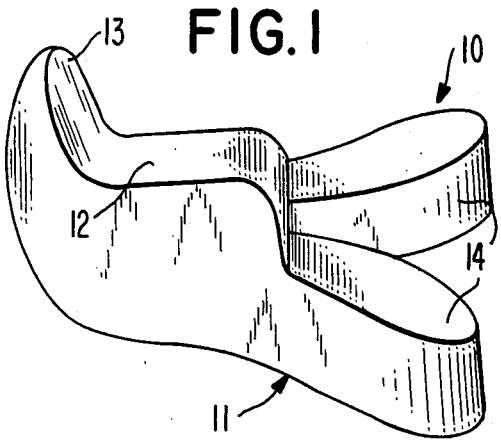
FIG. 1 is a perspective view of the present invention.
Figure 2:
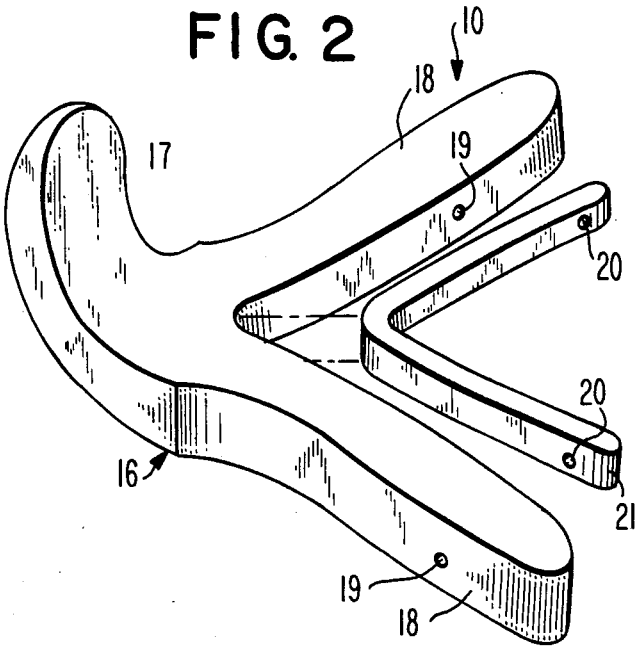
FIG. 2 is an exploded perspective view of the insert portion, shown removed from the invention.
Figure 3:
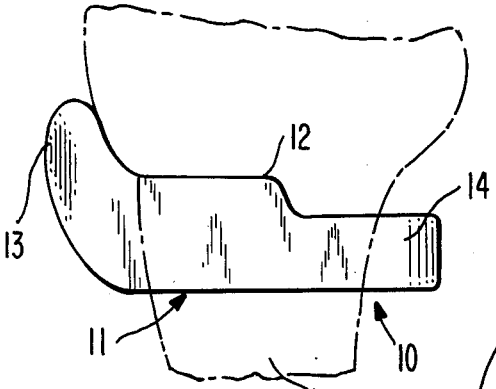
FIG. 3 is a side view of the invention, shown in elevation and illustrating the patient fragmentary and in phantom lines.
Figure 4:
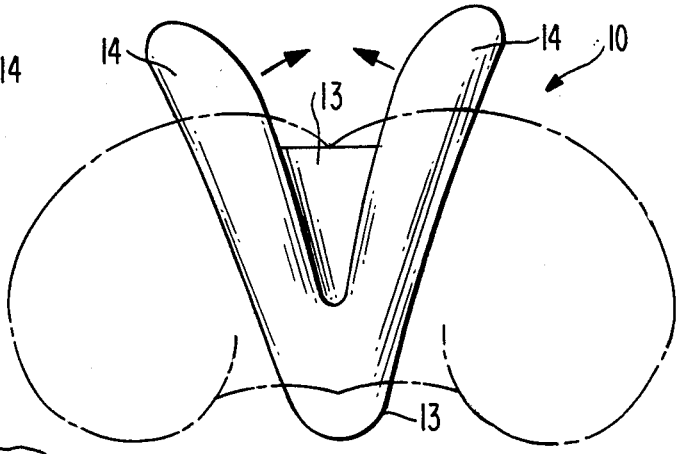
FIG. 4 is similar to FIG. 3, but is a bottom plan view.
Figure 5:
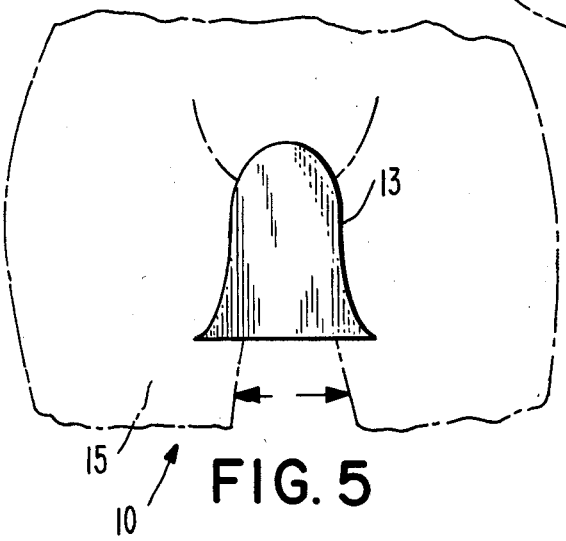
FIG. 5 is also similar, but is a front view.
Figure 6:
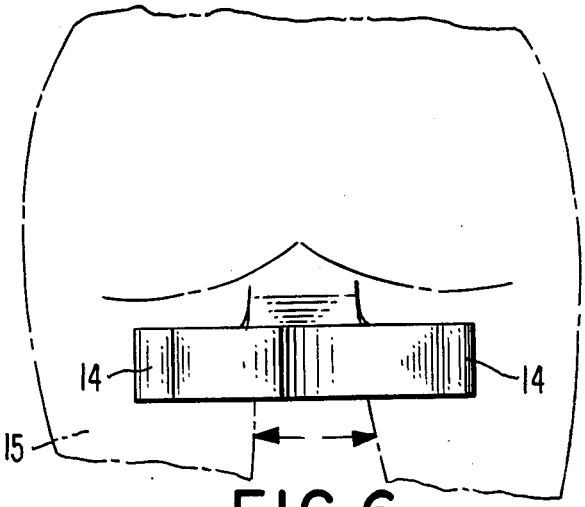
FIG. 6 is a rear view of FIG. 5.

A gynecology exercise device for restoring the muscles of the pelvic floor, comprising a main body or saddle body having a horn portion which is concave for cupping the vulva. A pair of rearwardly extending wing portions are also provided for proper positioning to effect the exercising intended.

DETAILED DESCRIPTION

Accordingly, an exercise device 10 is shown to include a main body 11 having an upper front portion 12 that continues upward as a horn portion 13, for cupping a patient's vulva. The horn portion is concave at the rear and a pair of wings 14 extend rearward at the bottom of main body 11, and form an apex. The horn portion 13 and the wings 14 which are received between the patient's legs 15, are integrally attached to main body 11 and the structure is fabricated of a suitable plastic or rubber. An insert 16 is provided as a core on the interior of device 10, and is shown to include an arcuate front portion 17 received in the horn portion 13. A pair of legs 18 are integrally attached to the front portion 17, and are provided with openings 19 that align with openings 20 of a spring 21 of "V"-shape. Suitable fasteners, not shown, are received in the openings 19 and 20 for fastening spring 21 to the insides of the legs 18, and it shall be noted, that device 10 may be manufactured in different sizes to fit different patients and the horn portion 13 is smoothly contoured, so as not to pinch the vulva when the wings 14 are closed during exercise.

In use, device 10 is placed with the wings 14 between the patient's legs 15 with the horn portion 13 engaging with the vulva. The patient then tightens the glueteal or buttock muscles with a forward thrust and pulls up on the abdominal muscle, which is almost automatic and closes the wings 14 of device 10. The abovementioned activates the muscles of the pelvic floor, and device 10 adds resistance to the muscles while they are in a flexed condition, creating the maximum development of the muscles in the shortest amount of time. The spring 21 serves to return the legs 14 to their normal outspread condition during the exercise.

It shall also be recognized, that the use of device 10 eliminates the mystery of which muscle to move, by tightening the sphincter muscle automatically with the other muscles, and by creating flexation even when it cannot work independently, which results in remarkable results.

While various changes may be made in the detail construction, such details will be within the spirit and scope of the present invention, as defined by the appended claims.

What I now claim is:

1. A gynecology exercise device, comprising, in combination, a main body, a horn portion integral with and extending upward from said main body, a pair of wings secured to said main body, and an insert core containing spring means received in said main body, said horn portion of said main body being concave at its rear surface for cupping the vulva of a patient, and said pair of wings of said main body extending rearward and being integrally attached to the rear of said main body and engaging with the inside surfaces of the thighs of said patient;

said pair of main body portion wings being integrally attached at their front end portions to the rear of said main body to form an angular apex, and capable of being closed together by pressure from said thighs of said patient during exercise with said device;

said insert core being fixedly secured within said main body and including an upwardly extending front portion received in said horn portion of said main body, and diverging leg members integrally attached to said front portion of said insert core and being received in said pair of wings of said main body portion.

2. The combination as set forth in claim 1, wherein said spring means comprise a "V"-shaped spring secured to the inside of said leg members of said insert core within said main body of said device, by suitable fasteners, and when said wings are compressed together by said thighs of said patient, said wings are returned to their normal outward positions by said spring when said thighs release pressure on said wings.

3. A pelvic exercise device comprising:

a main body portion made of a flexible material;

a pair of wing members integral with said main body and extending rearward therefrom in a Vee configuration to engage between the thighs of a user;

a V-shaped insert core secured in said main body with the legs thereof received in said wing members;

the legs of said insert core being relatively stiff but flexible so that said wing members can be closed together by pressure from the thighs of said user to return to a normal relatively spread condition when such pressure is released.

4. The pelvic exercise device defined in claim 3 wherein:

the outer surface of said wing members are concave to fit the inner surfaces of a user's thighs.

5. The pelvic exercise device defined by claim 3 including:

an integral horn portion extending upward from said main body;

the rear surface of said horn portion being concave.

* * * * *